US007106662B1

(12) United States Patent
Acker, Jr.

(10) Patent No.: US 7,106,662 B1
(45) Date of Patent: Sep. 12, 2006

(54) THERMAL ALARM CLOCK

(75) Inventor: Phillip F. Acker, Jr., 505 Edinburgh St., San Mateo, CA (US) 94402

(73) Assignee: Phillip F. Acker, Jr., San Manteo, CA (US)

( * ) Notice: Subject to any disclaimer, the term of this patent is extended or adjusted under 35 U.S.C. 154(b) by 358 days.

(21) Appl. No.: 10/649,620

(22) Filed: Aug. 28, 2003

Related U.S. Application Data

(60) Provisional application No. 60/407,775, filed on Sep. 3, 2002.

(51) Int. Cl.
*G04B 23/02* (2006.01)
*G04B 21/00* (2006.01)
*G04B 23/00* (2006.01)

(52) U.S. Cl. ..... 368/73; 368/244

(58) Field of Classification Search ..... 368/10, 368/71–74, 243, 244, 250; 219/212, 258
See application file for complete search history.

(56) References Cited

U.S. PATENT DOCUMENTS 3,255,582 A 6/1966 Zam
3,455,102 A 7/1969 Wolf
3,798,889 A 3/1974 Chadwick
3,968,417 A 7/1976 Dials
4,132,262 A * 1/1979 Wibell ..... 165/206
4,228,806 A 10/1980 Lidow
4,370,602 A 1/1983 Jones, Jr. et al.
4,645,353 A 2/1987 Kavoussi et al.
4,821,247 A 4/1989 Grooms
5,089,998 A 2/1992 Rund
5,282,181 A 1/1994 Entner et al.
5,948,303 A * 9/1999 Larson ..... 219/486
6,236,622 B1 5/2001 Blackman
6,888,779 B1 * 5/2005 Mollicone et al. ..... 368/10

* cited by examiner

*Primary Examiner*—Andrew H. Hirshfeld
*Assistant Examiner*—Leo T. Hinze
(74) *Attorney, Agent, or Firm*—Martine Penilla & Gencarella, LLP

(57) ABSTRACT

A thermal alarm clock including an alarm clock controller that activates a heating device to wake a slumbering person. The thermal alarm clock incorporates traditional alarm, clock, and radio functions as well. The heating device is located adjacent a sleeping person and can be activated with, or instead of, an audible alarm. A slumbering person will be gently awakened by the heat of the device instead of the jarring sound from an audible alarm clock. The thermal alarm clock is also effective at waking a single person from a plurality of sleepers and is effective for users with special needs, such as the hearing impaired or blind. In one embodiment, the thermal alarm clock incorporates sensors and circuitry to monitor a user's presence.

25 Claims, 3 Drawing Sheets

THERMAL ALARM CLOCK

This application claims the benefit of U.S. Provisional Application No. 60/407,775, filed Sep. 3, 2002, the disclosure of which is hereby incorporated herein by reference.

FIELD OF THE INVENTION

This present invention is directed generally to an alarm clock. More particularly, the present invention is directed to a thermal alarm clock that can awaken a sleeping person by activating a heating device.

BACKGROUND OF THE INVENTION

Millions of people use alarm clocks to wake themselves up in the morning. Typically, an alarm clock will sound an audible alarm, such as a ringing or buzzing sound, to wake up a person at a preset time. These audible alarm clocks can be driven mechanically or electrically. In either case, the waking experience produced by an audible alarm clock is very abrupt and jarring.

A major advancement in the alarm clock's waking experience was the integration of the radio. So-called "clock radios" allow a person to wake up while listening to a radio broadcast. It is thought that using the sound of music or talking as a means to wake up is a more comfortable experience than being assaulted with a ringing or buzzing noise. While music does help to reduce the jarring effect associated with a buzzing alarm, the waking experience is often still abrupt. The radio alarm also loses its effectiveness as the human body adjusts to the radio station.

Another downside to any audible type alarm is that they are ineffective for hearing-impaired people. Therefore, vibrating alarm clocks have been developed. These alarms typically pulsate a pillow or mattress in an attempt to wake up the sleeping individual. Pillow vibrators are undesirable because a sleeping person's head may not be in contact with the pillow, or the pillow may be pushed aside. Mattress vibrators do not work well with the cabin style beds that do not have a box spring or bed frame. Users need alarm clocks that are consistently effective. In particular, the hearing impaired would benefit from an effective silent alarm clock.

Alarm clocks have also incorporated visual methods for arousing a person. For example, an alarm clock can be used to turn on a room's lights when the alarm is activated. This is useless for blind users, and sleeping individuals tend to avoid bright lights, thereby rendering these alarms largely ineffective. In any event, waking up to a suddenly bright room is just as jarring and annoying as an audible alarm.

Yet another branch of alarm clocks are wearable alarm clocks, including vibrating wristbands and ear mounted audible alarms. However, many people find sleeping with devices attached to them uncomfortable. Some people will even remove these objects, such as wristbands or earplugs, when they fall asleep. These devices can also be inadvertently dislodged during the night. As a result, these types of alarms are not very effective.

When there is more than one sleeping person within range of an alarm clock, it is to be expected that the people may desire to wake up at different times. The traditional audio and visual alarms disturb everyone in the vicinity. Therefore, couples or roommates would also benefit from a silent alarm clock that can wake a single individual.

It can be seen that a need exists for an alarm clock that is effective for a wide variety of users that also provides a gentle waking experience. Ideally, the alarm clock would incorporate known features and alarm options so that it is both easy-to-use and adaptable to individual preferences. The improved alarm clock would be comfortable, safe, and effective for all users, including those with special needs such as the hearing impaired or blind. The alarm clock could also wake a single individual from a plurality of sleeping people. The thermal alarm clock in accordance with the present invention provides such an alarm clock, and it overcomes the obstacles and deficiencies that have prevented the development of a satisfactory silent alarm clock.

SUMMARY OF THE INVENTION

In accordance with the present invention, a thermal alarm clock is provided that incorporates an alarm clock controller that activates and deactivates a heating device at, and for, a specified time. The heating device, when activated, is usable to warm an individual, preheat a sleeping surface, or to wake a sleeping individual The thermal alarm clock of the present invention overcomes obstacles and shortcomings that have previously inhibited the development of an effective, yet gentle, alarm clock. It is effective for users with special needs, such as the hearing impaired or blind. Moreover, the heating device of the thermal alarm is comfortable, safe, and usable to silently wake a person.

The thermal alarm clock includes a number of conventional features and options. For example, the thermal alarm clock can activate a traditional alarm, such as an audible alarm or radio broadcast, at a preset time. The thermal alarm clock can include other common features like volume controls, radio station controls, and a "sleep" button, which activates the radio for a predetermined or user-defined period of time. A battery backup system maintains the clock feature and activates the audible or radio alarms during a power outage. Generally, the thermal alarm clock can operate as a traditional alarm clock.

The alarm clock controller is usable to activate the heating device with the heating device being electrically connected to the alarm clock controller or a heat level controller. In one embodiment, the heating device is provided by the user and is electrically connected to the alarm clock controller by plugging the heating device into a standard electrical outlet provided by the alarm clock controller. For example, a traditional heating pad with or without built-in heating controls could be connected to the alarm clock controller. In a second embodiment, the thermal alarm clock includes a heating device specifically constructed to operate only with the alarm clock controller. The electrical outlet would be specially shaped to accept a like-shaped power cord. This proprietary heating device would be activated by the alarm clock controller and would, in one preferred embodiment, incorporate a heat level controller. In yet another embodiment, the alarm clock controller includes both standard and specially shaped electrical outlets for both user-provided and proprietary heating devices. A plurality of receptacles could wake different users at different times. Another special feature involves a "preheat" button. When pressed, the preheat button would immediately activate the heating device for a predetermined or user-defined period of time. The heating device itself can take several forms but is preferably a heating pad that is secured to a mattress.

In use, the alarm clock controller activates the heating device when the clock reaches a preset time or when the user depresses the preheat button. The alarm clock controller provides electrical power to the one or more electrical outlets. The attached heating devices are electrically connected to the outlet. The electrical power serves to increase the temperature of the heating devices, typically through electrical resistance, to wake a sleeping person. The heat level controller can be a manual knob, as found on a typical heating pad, usable to set the temperature of the heating pad. In the case of the proprietary heating device, the heat level controller can be set to mimic natural body temperature changes that occur in a waking person. For example, the heat level controller would slowly increase electricity to the heating device. The user could also manually adjust the temperature through the heat level controller based on his or her own tolerances and needs. In another preferred embodiment, the thermal alarm clock includes logic circuitry and sensors, such as pressure sensors, optical sensors, or the like, to determine whether a person is present or in contact with the heating device. The logic circuitry monitors the user's waking profile to determine the optimal combination of heating level and heating time to maximize the waking effectiveness without jarring the user. In this embodiment, the electrical power provided to the heating device could be terminated when the user is no longer in contact with the heating device.

The use of heat to wake a person allows the thermal alarm clock to silently and effectively rouse a person. An added benefit is that other people in the room would not be disturbed, and it is equally effective for users with special needs. Further objects and advantages will become apparent from a consideration of the ensuing description and drawings.

BRIEF DESCRIPTION OF THE DRAWINGS

The various other objects, features and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE INVENTION

While the invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

Figure 1:
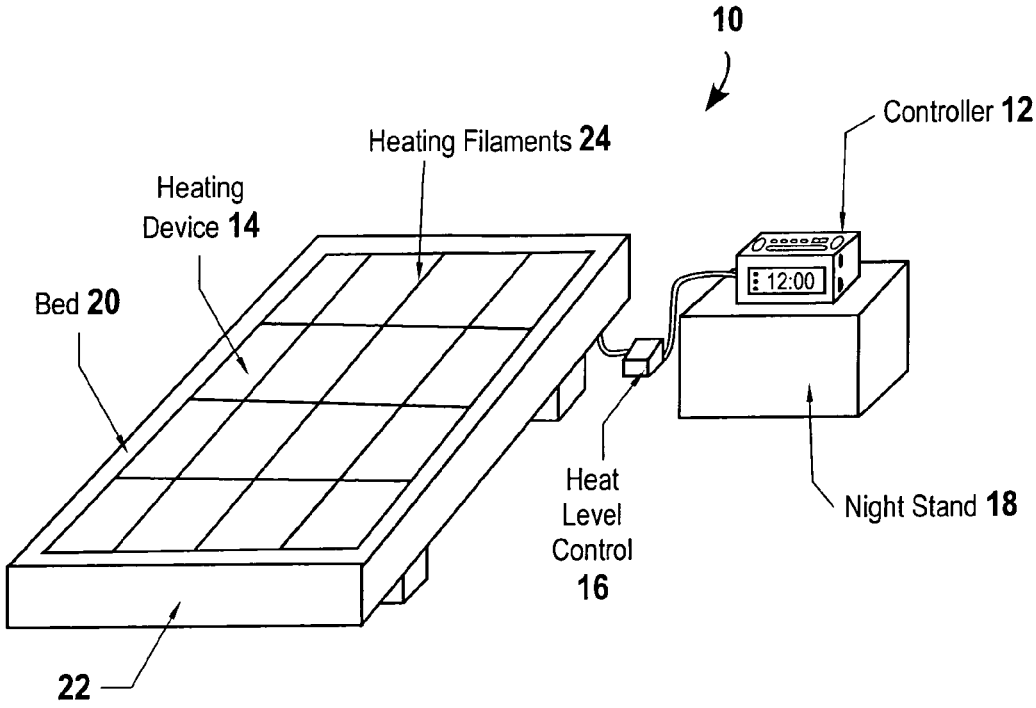
FIG. 1 is a perspective view of a first preferred embodiment of a thermal alarm clock in accordance with the present invention.

Referring initially to FIG. 1, there may be seen generally at 10 a first preferred embodiment of a thermal alarm clock in accordance with the present invention. In this first preferred embodiment, thermal alarm clock 10 consists of three main components: an alarm clock controller 12, a heating device 14, and an optional heat level controller 16. As illustrated, thermal alarm clock 10 rests on a nightstand 18 adjacent a bed 20. The heating device 14 is secured to a mattress 22 on bed 20. Heat level controller 16, if included, is situated between, and in electrical connection with, heating device 14 and alarm clock controller 12. Heat level controller 16 can also be included within alarm clock controller 12. While heat level controller 16 would be internal to alarm clock controller 12 in this embodiment, it would still provide a manual means to adjust the temperature level of heating device 14. The manual means for adjusting the heat in either the external or internal embodiment consists of a knob, switch, buttons, or the like.

Figure 2:
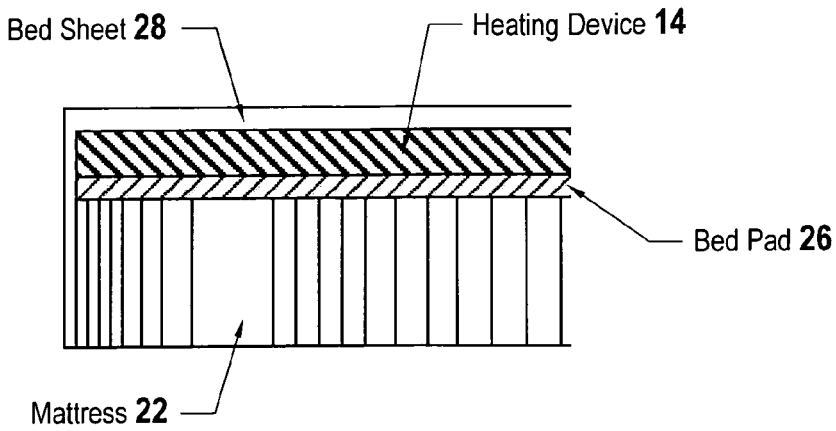
FIG. 2 is a side view of the first preferred embodiment of a heating device usable with the thermal alarm clock of the present invention.

FIG. 2 further illustrates a first preferred embodiment for heating device 14 on bed 20. Mattress 22 is placed on the bed frame (not shown). On top of the mattress is a bed pad 26. Above the bed pad 26 is heating device 14. On top of heating device 14 is a bed sheet 28.

Heating device 14 is illustrated in FIGS. 1 and 2 as a traditional heating pad. The heating pad can include known means for securing the pad to mattress 22. Such heating pads contain filaments 24 that heat up by electrical resistance. It should be understood that heating device 14 might be a device other than a heating pad so long as the device can effectively and safely apply heat to a sleeping user. Moreover, heating device 14 could be used in a variety of places besides being placed atop a mattress.

In one preferred embodiment, heating device 14 contains typical electrical switches (not shown) that control whether electricity reaches filaments 24 in different zones of the heating device. The switches operate to vary the location of heat within heating device 14. Therefore, heating device 14 is usable to alternate between heating a user's upper and lower body during a waking cycle. Moreover, heating device 14 is capable of covering the entirety of mattress 22 while remaining usable to wake up bed partners at distinct times. For instance, one zone of the pad would wake a first user while a second zone of the pad would wake a second user.

Figure 3:
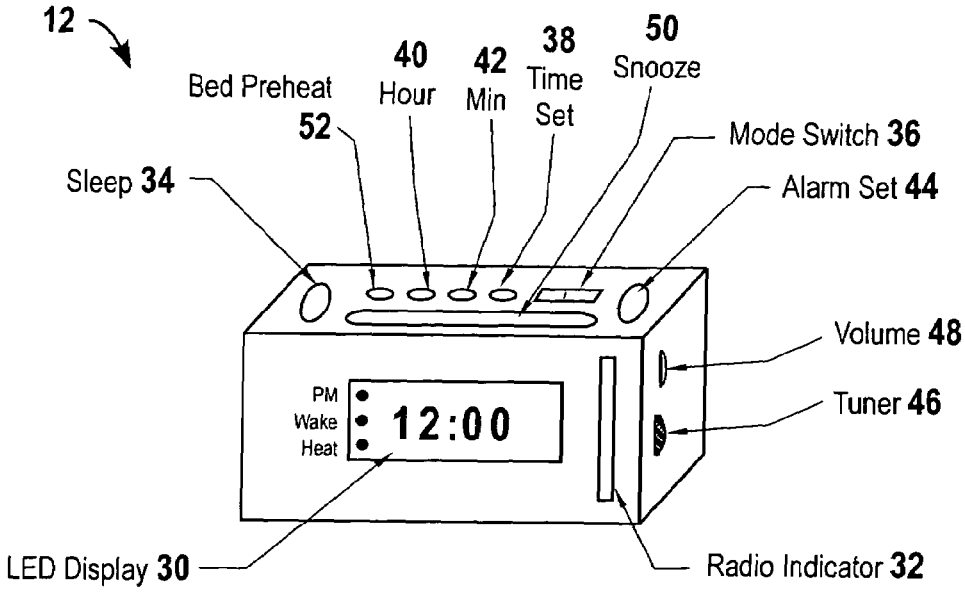
FIG. 3 is a front perspective view of the alarm clock controller in accordance with the present invention.

Turning to FIG. 3, there is illustrated a close up view of alarm clock controller 12. Alarm clock controller 12 is illustrated in a generally rectilinear shape that is typical to known alarm clocks. Preferably, alarm clock controller 12 also includes functions common to a traditional alarm clock such as wake to radio, wake to audible alarm, radio tuning, and the like. A battery backup system (not shown) can maintain the clock feature and activate the audible or radio alarms during a power outage. It is currently envisioned that the battery backup system would default from the "wake to heat" function to one of the other methods for waking a user. However, it thought that a more robust battery could maintain the "wake to heat" function. Other traditional physical characteristics such as a LED display 30, a radio tuning indicator 32, a sleep button 34 and other buttons that operate the various functions are also included. For instance, a mode switch 36 selects between the various states of the alarm's operation. The alarm can be set to off, radio, wake by heating device, wake by audible alarm, wake by radio or any combination thereof.

The clock function, displayed by LED display 30, is set through the use of a time set button 38, in conjunction with an hour button 40 and a minute button 42. The waking time is set through the use of an alarm set button 44 in conjunction with hour button 40 and minute button 42. As is known in the alarm clock art, the user sets either the clock time or waking time by holding the respective set button and advancing the time by pressing the hour and/or minute buttons 40, 42.

The radio function is also controlled by conventional means, namely by a tuning dial 46 on the side of alarm clock controller 12 that is usable to change radio stations. The current tuner position is indicated on tuning indicator 32. A volume adjustment dial 48 is positioned above tuning dial 46 on one side of alarm clock controller 12.

Other features include a snooze button 50, sleep button 34, and preheat button 52. Snooze button 50 is located atop alarm clock controller 12 and is used to temporarily turn off the selected alarm mechanism for a predetermined number of minutes. Sleep button 34 and bed preheat button 52 activate the radio and heating device 14, respectively, for a predetermined or user-defined number of minutes. Pressing either button once activates the respective function for a predetermined amount of time. A user can define the amount of time the function is active by holding either button and adjusting the time by pressing the hour and/or minutes buttons 40, 42. In this manner, the radio and heat functions can be manually activated by the user but automatically deactivated by alarm clock controller 12.

Figure 4:
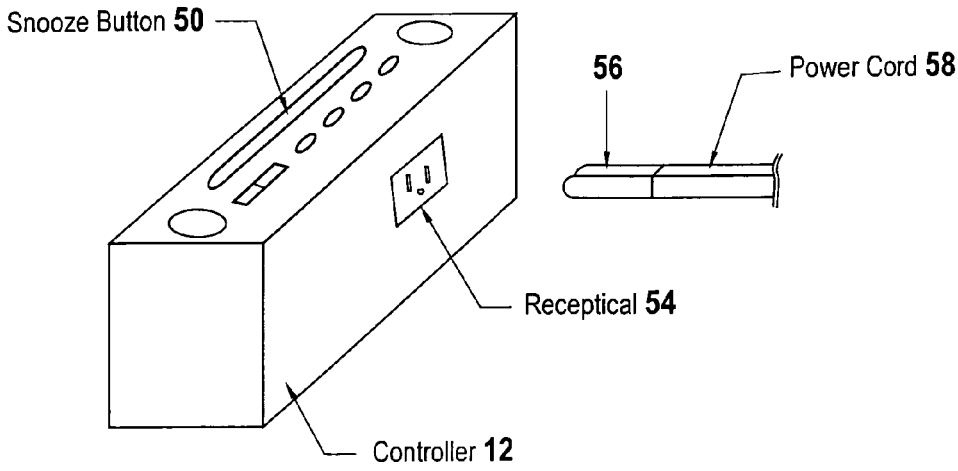
FIG. 4 is a rear perspective view of the alarm clock controller and heating device's power cord in accordance with a first preferred embodiment.

FIG. 4 illustrates one embodiment of the backside of alarm clock controller 12, wherein the controller provides a standard female electrical receptacle 54. In this embodiment, the user can provide their own heating device. The user's device will plug into electrical receptacle 54 and will be activated by alarm clock controller 12. Heating device 14 has a male electrical plug 56 and a power cord 58. Thermal alarm clock 10 is connected to a power source (not shown). Therefore, activating heating device 14 consists of switching on the power to electrical receptacle 54 by circuitry known to those familiar with the art. The user's device may or may not include a mechanism for adjusting the heat level of the heating device.

Figure 5:
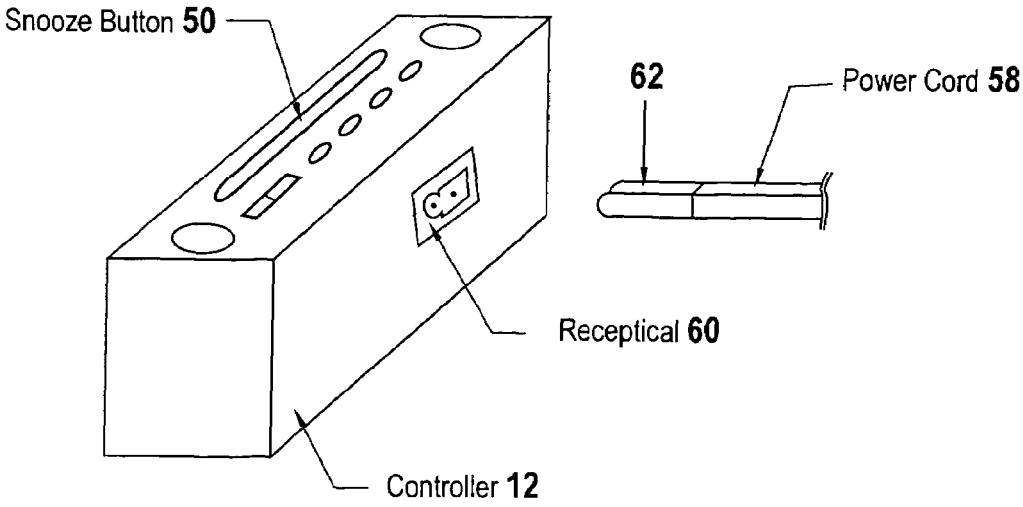
FIG. 5 is a rear perspective view of the alarm clock controller and heating device's power cord in accordance with a second preferred embodiment.

It is also contemplated that a specially shaped electrical receptacle 60 could be formed to accept power cord 58 by way of a proprietary plug 62, as illustrated in FIG. 5. In this embodiment, heat level controller 16 would incorporate a means for adjusting the temperature level of heating device 14. Therefore, heat level controller 16 includes a labeled knob or other user actuated device. The manual adjustment would control the voltage or current to heating device 14. For example, a knob on heat level controller 16 could be connected to a potentiometer. The potentiometer would adjust the voltage supplied to heating device 14. In a preferred embodiment, labeling on heat level controller 16 corresponds to the amount of electricity applied to heating filaments 24. Therefore, alarm clock controller 12 activates heating device 14 by switching on electricity to proprietary plug 62. However, the amount of electricity passed to heating device 14 could be adjusted at heat level controller 16. As mentioned above, heat level controller 16 can also be incorporated into alarm clock controller 12 so long as the means to adjust the temperature of heating device 14 is still accessible to a user.

Still other modifications and forms exist. It is apparent that a plurality of receptacles could be provided on alarm clock controller 12 so as to provide different waking times for different users. One or more of the receptacles could be a standard female electrical receptacle. Likewise, one or more of the receptacles could be specially shaped for use with a proprietary heating device and power cord. In either case, a single alarm clock controller 12 is usable to activate a plurality of heating devices 14. Further, the electrical receptacles, either proprietary or standard, could be located on an external heat level controller 16 instead of within alarm clock controller 12.

Figure 6:
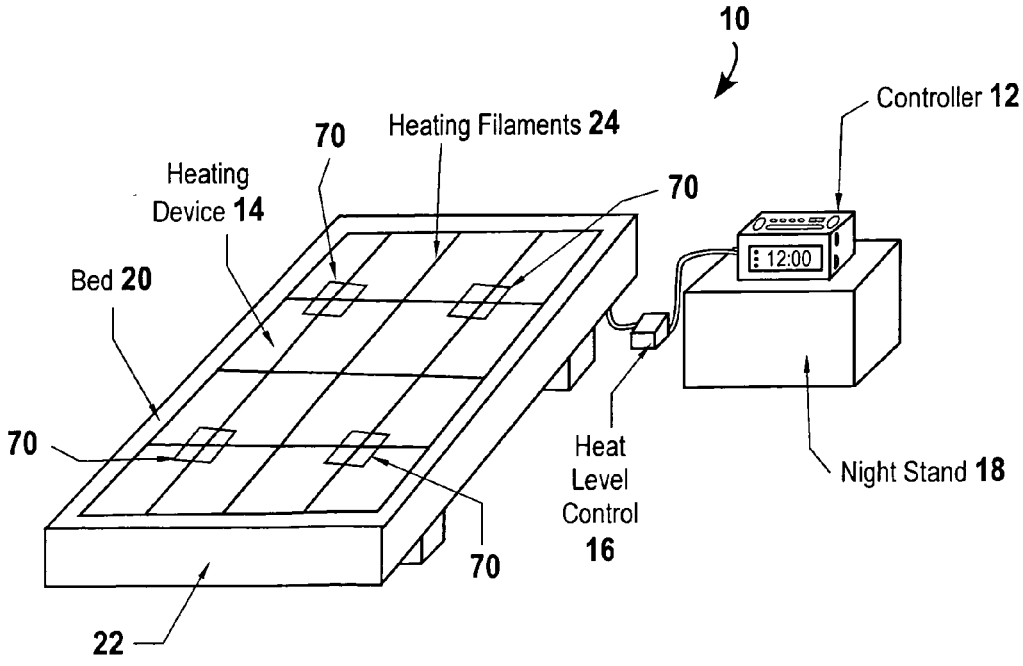
FIG. 6 is a perspective view of a second preferred embodiment of a thermal alarm clock in accordance with the present invention.

In yet another preferred embodiment, as illustrated in FIG. 6, thermal alarm clock 10 includes logic circuitry (not shown) and sensors 70, such as pressure sensors, optical sensors, or the like, to determine whether a person is present or in contact with the heating device. For instance, pressure sensors 70 are activated when a user is in contact with the heating device. During activation, sensors 70 send a control signal to alarm clock controller 12. When the user separates from heating device 14, sensors 70 are deactivated and the control signal terminates. In this embodiment, heating device 14 is switched off when the user is no longer in contact with it.

The sensors and logic circuitry are usable in combination to determine the optimal temperature and heating time to maximize the waking effectiveness without jarring the user. The logic circuitry monitors the sensors. For example, if alarm controller 12 activates heating device 14 at 7:30 AM but the sensors register a user's presence until 7:38 AM, the eight-minute wake-up time could be recorded to memory by the logic circuitry. The logic circuitry then adjusts the heating cycle to begin at 7:22 so that the user is awake by the specified time of 7:30. Preferably, sensors 70 are pressure sensors that detect a user's weight on heating device 14, and the logic circuitry operates by recording the average time between the activation of the alarm and the time sensors 70 no longer detect the user.

Again, it should be understood that the invention is not intended to be limited to the particular forms disclosed herein. Rather, the invention is to cover all modifications, equivalents, and alternatives falling within the spirit and scope of the invention as defined by the following appended claims.

What is claimed is:

1. An alarm clock comprising:

an alarm clock controller electrically connected to an electrical power source;

at least one electrical connector electrically coupled to the alarm clock controller;

at least one sensor operable to detect a presence of a user;

logic for monitoring the at least one sensor;

logic for recording a time between an activation of the at least one electrical connector and a detected absence of the user; and logic for adjusting an activation time of the at least one electrical connector wherein said alarm clock controller includes a circuit operable to switch electricity on and off to the at least one electrical connector, and wherein the adjustment to the activation time is based on a function of the recorded time.

2. The alarm clock of claim 1, further comprising a heat level controller electrically connected to the alarm clock controller and the at least one electrical connector.

3. The alarm clock of claim 2, wherein the heat level controller is adjustable to vary a flow of electricity to the at least one electrical connector when the electricity is switched on to the at least one electrical connector.

4. The alarm clock of claim 1, further comprising at least one heating device electrically coupled to the at least one electrical connector.

5. The alarm clock of claim 4, wherein the at least one heating device includes at least one of a heating pad or an electrically heated blanket.

6. The alarm clock of claim 4, wherein the heating device further includes one or more electrical switches operable to connect electricity to corresponding one or more zones of the heating device.

7. The alarm clock of claim 1, wherein the alarm clock controller includes a circuit to manually switch the at least one electrical connector for a period of time.

8. The alarm clock of claim 1, wherein the at least one electrical connector is deactivated when the user is not present.

9. The alarm clock of claim 1, wherein:

the function is an average time a user wakes after the activation of the at least one electrical connector.

10. A thermal alarm clock comprising:

an alarm clock controller;

a heat level controller in electrical connection with the alarm clock controller;

at least one heating device electrically connected to the alarm clock controller;

at least one sensor operable to detect a presence of a user;

logic for monitoring the at least one sensor;

logic for recording a time between the activation of the at least one heating device and the absence of a user;

logic for adjusting the activation time of the at least one heating device; and wherein said alarm clock controller activates and deactivates said at least one heating device by switching electricity on and off to said at least one heating device, and wherein the adjustment to the activation time is based on a function of the recorded time.

11. The thermal alarm clock of claim 10, wherein the at least one heating device wherein the at least one heating device includes at least one of a heating pad or an electrically heated blanket.

12. The thermal alarm clock of claim 10, wherein the heating device further includes one or more electrical switches operable to connect electricity to corresponding one or more zones of the heating device.

13. The thermal alarm clock of claim 10, wherein the heat level controller includes a circuit operable to variably adjust a flow of electrical power to the at least one heating device when the alarm clock controller activates the at least one heating device.

14. The thermal alarm clock of claim 10, wherein the alarm clock controller includes a circuit to manually activate the at least one heating device for a period of time.

15. The thermal alarm clock of claim 10 wherein the at least one heating device is deactivated when the user is not present.

16. The thermal alarm clock of claim 10, wherein the function is an average time a user wakes after the activation of the at least one heating device.

17. The thermal alarm clock of claim 10, wherein the alarm clock controller includes at least one electrical connector and the at least one heating device is electrically connected to the alarm clock controller through the at least one electrical connector.

18. A method for waking a user comprising:

selecting an initial activation time in an alarm clock controller;

detecting a presence of a user;

selecting a wake time occurring after the initial activation time;

recording a time between the initial activation time and a detected absence of the user;

activating at least one heating device at the in initial activation time, the at least one heating device being electrically coupled to the alarm clock controller; and automatically selecting a subsequent activation time of the at least one heating device based on a function of the time.

19. The method of claim 18, wherein the at least one heating device includes at least one of a heating pad or an electrically heated blanket.

20. The method of claim 18, wherein the heating device includes a plurality of electrical switches operable to connect electricity to corresponding zones of the heating device.

21. The method of claim 18, further comprising varying a flow of electricity to the at least one heating device when the alarm clock controller activates the at least one heating device.

22. The method of claim 18, wherein the at least one heating device is activated for a preselected period of time at the initial activation time.

23. The method of claim 18, further comprising manually activating the at least one heating device for a preselected period of time.

24. The method of claim 18, wherein the at least one heating device is deactivated if the user is not present.

25. The method of claim 18, wherein automatically selecting a subsequent activation time of the at least one heating device the function of the time is an average of the time between the activation time and the detected absence of the user.

* * * * *